United States Patent [19]

Weon Joong

[11] 4,399,567

[45] Aug. 23, 1983

[54] PREVENTIVE DEVICE OF RUBBER GLOVE AGAINST FLUID-STAIN

[76] Inventor: Sohn Weon Joong, 301-1 Soongi-2dong, Nam-Gu, Inchon, Kyonggi-province, Rep. of Korea

[21] Appl. No.: 254,978

[22] Filed: Apr. 16, 1981

[51] Int. Cl.[3] ..... A41D 19/00

[52] U.S. Cl. ..... 2/161 R; 2/162

[58] Field of Search ..... 2/161 R, 159, 158, 162

[56] References Cited

U.S. PATENT DOCUMENTS 1,633,300 6/1927 Wetzstein ..... 2/158

1,924,617 8/1933 Miller ..... 2/162 X

*Primary Examiner*—Richard J. Scanlan, Jr.

*Attorney, Agent, or Firm*—Fleit, Jacobson & Cohn

[57] ABSTRACT

A protective glove with finger receiving and integral forearm portions having an integral round outwardly extending ring formed around the forearm portion, spaced from the end thereof and spaced from the exterior surface thereof by a narrow, integral and continuous wall forming a gutter to collect and divert fluid flow from either end of the glove.

1 Claim, 2 Drawing Figures

FIG. 1
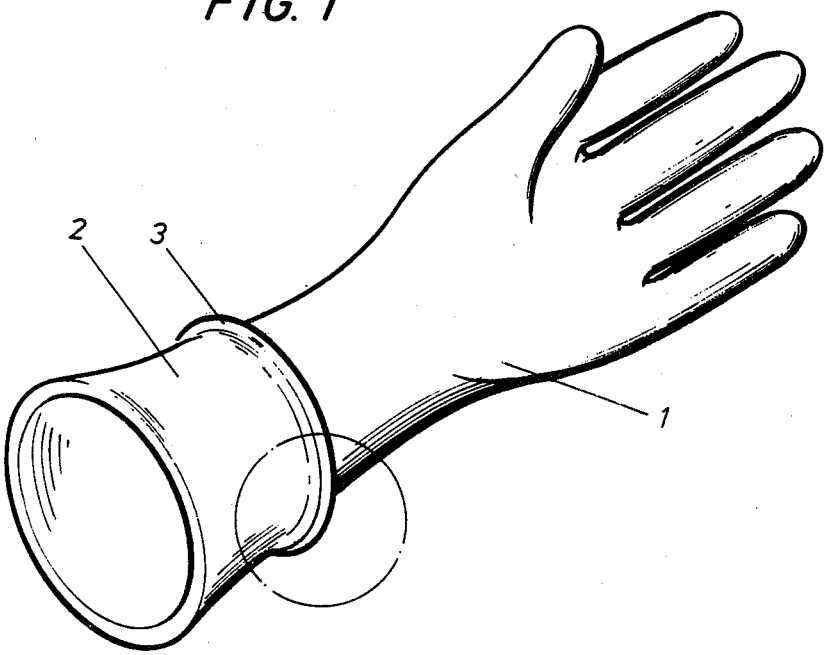
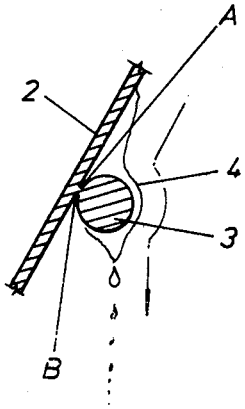
FIG. 2

PREVENTIVE DEVICE OF RUBBER GLOVE AGAINST FLUID-STAIN

BRIEF DESCRIPTION OF DRAWINGS

FIG. 1: Shows a perspective view of the invention.

FIG. 2: Shows an enlargement of the principal parts of the glove of the present invention and their operation when fluid flows along the outer surface of the glove.

DETAILED DESCRIPTION OF THE PREFERRED EMBODIMENTS

This invention relates to a protective glove. Particularly, this invention relates to a fluid stain preventive device for a protective glove which is made of rubber or P.V.C.

In a conventional rubber glove which is used for protective purposes in handling various noxious fluids, there is a defect in that the fluid overflow to the forearm portion of the glove flows to the clothes or skin as the gloved hands are raised to lift the goods above the horizontal level. In order to prevent such an unwanted overflow, a flow preventive band device having an obliquely extending, outwardly directed lip was attached. This type of flow prevention device for a rubber glove is faulty in that the band device gets furled, or the fluid overflows the device when the liquid flows in large quantities.

There is another type of preventive glove to which an absorbent material was attached. This glove is ineffective in that the absorbent has a limited absorbing capability, and no durability, offering less effectiveness in operation. This invention remedies the aforementioned defects. A ring shaped round projection is provided on the exterior part of the glove and attached thereto by a narrow integral, continuous wall so that the round projection extends therefrom and is three dimensional.

While wearing the glove of the present invention, the clothes and skin of the wearer do not become wetted by the overflowing fluid even in the case where the wearer raises his hands, since the flowing fluid is held back by the protective device to fall down to the ground. The same principle is applicable when perspiration flows downward along the glove, as for example during an operation at a hospital. The following is a more detailed explanation concerning the attached drawings.

The rubber glove of this invention is composed of a ring shaped round projection(3) attached to the forearm portion(2) of the exterior part of the publicly known glove(1), in such a manner as to be both projecting and three dimensional. The portion under the numeral 4 shows fluid on the outer surface of glove(1). When the gloved hand is raised above the horizontal level while noxious fluid is to be handled by the gloved hands, the fluid(4) covering the exterior part of the glove falls down to the ground by way of the projecting ring type projection(3) at the forearm portion(2) of the glove(1). Thus, the fluid(4) is first collected in the gutter portion(A) which is formed between the ring shaped projection(3) and the exterior part of glove(1), forming drops to fall down to the floor. The ring shaped round projection(3) can be durable since it is produced as an integral, single body.

What is claimed is:

1. In a protective glove having a finger-receiving portion and an integral forearm portion, the improvement comprising a rounded, outwardly extending ring of circular cross section formed integrally at the forearm portion of said glove at a point spaced from the outer end of said forearm portion, said ring spaced from the exterior surface of said glove and connected thereto by a narrow, integral, continuous wall, said outwardly extending ring and the exterior portion of said glove defining a gutter portion on each side of said ring to collect and divert fluid flowing along said exterior portion to permit said fluid to drop from said projection and thereby divert said fluid from flowing beyond said ring.

* * * * *